US005813690A

United States Patent [19]

Dogat

[11] Patent Number: 5,813,690

[45] Date of Patent: Sep. 29, 1998

[54] ELEMENT FOR HOLDING A BOOT IN POSITION ON A SKI

[75] Inventor: Vincent Dogat, Annecy, France

[73] Assignee: Salomon S.A., Anncey Cedex, France

[21] Appl. No.: 667,035

[22] Filed: Jun. 19, 1996

[30] Foreign Application Priority Data

Jun. 22, 1995 [FR] France ..... 95 07694

[51] Int. Cl.[6] ..... A63C 9/084

[52] U.S. Cl. ..... 280/634; 280/633

[58] Field of Search ..... 280/633, 634, 280/607, 632; 441/70

[56] References Cited

U.S. PATENT DOCUMENTS

| | | | |
|---|---|---|---|
| 4,157,193 | 6/1979 | Beyl | 280/633 |
| 4,620,719 | 11/1986 | Stritzl | 280/633 |
| 4,699,398 | 10/1987 | Luschnig et al. | 280/633 |
| 5,209,516 | 5/1993 | Arduin et al. | 280/633 |

FOREIGN PATENT DOCUMENTS

| | | |
|---|---|---|
| 2 451 756 | 10/1980 | France . |
| 2 614 545 | 11/1988 | France . |
| 2 647 357 | 11/1990 | France . |
| 0 498 153 A1 | 8/1992 | France . |
| 0 548 468 A1 | 6/1993 | France . |
| 383 309 B | 5/1987 | Germany . |
| 387 150 B | 12/1988 | Germany . |

*Primary Examiner*—Eric D. Culbreth
*Assistant Examiner*—Abraham Lerner
*Attorney, Agent, or Firm*—Pollock, Vande Sande & Priddy

[57] ABSTRACT

An element for position retention of a boot on a ski. This element comprises a body (3) movable along a slide-rail (6) and a locking device (13) for immobilizing the body along the slide-rail in a defined position. The locking device is extended upward by a "T"-shaped control mechanism (14) which extends upward along the rear face of the body.

8 Claims, 2 Drawing Sheets

ELEMENT FOR HOLDING A BOOT IN POSITION ON A SKI

FIELD OF THE INVENTION

The invention concerns an element for holding a boot in position on a sliding board, in particular a ski. More precisely, the invention concerns a device used to adjust the longitudinal position of a retention element on a ski.

BACKGROUND OF THE INVENTION

It is known that a boot is held in place on a ski by means of a front and a rear position-retention element. In conventional fashion, each element incorporates a jaw carried by a body which, when acted upon by boot-generated stresses, moves against the return force of a spring housed in the body.

The body of the rear element is conventionally movable along a slide-rail, and a locking device makes it possible to position the body in a precise position adjusted to match the length of the boot. From this position as defined by the locking device, the body can still slide rearward, when the boot is engaged and during flections of the ski, against the return force of one or more springs, termed backward-motion springs. In addition, the front position-retention element incorporates a body which moves along a slide-rail.

In a rear position-retention element, the backward-motion spring or springs determine the thrust the position-retention element imparts to the boot, the front element forming a stationary stop-motion device on the ski. Thrust depends on the longitudinal position of the body along the slide-rail. An initial position in which the rear element is pushed too far back gives excessively low thrust, thus causing loose position maintenance of the boot in the retention elements, a high degree of imprecision as regards control of the ski, and a high risk of untimely disengagement because of the premature release of the boot. An initial position in which the rear element is positioned too far forward makes the boot difficult to put on. Thrust is too strong, thus disrupting the correct operation of the position-retention elements.

Adjustment of the longitudinal position of the position-retention elements, in particular of the rear element, is an important operation determining the proper functioning of these elements. Some experience is required to effect this operation, since it is necessary to ensure that the thrust occur within the correct range of values. A ski specialist may easily carry out this operation; generally, however, the ski user does not possess the skill to make the adjustment himself or to restore proper adjustment after the element has shifted accidentally.

Thus, from the perspective of the specialist, the locking device making possible this longitudinal adjustment must be accessible and easy to operate. In addition, once the locking device is placed in the open position, the body of the element must be easily operable in order to move it into a new position. This is especially important in rental skis, which must be adjusted for each new user.

As regards the user, the locking device must be well-protected so that it cannot open accidentally, for example during skiing, as a result of impacts caused by the other ski during a fall or of the skis of other skiers waiting in lift lines. It is also necessary to prevent the locking device from opening accidentally during the transport and handling of skis.

A locking device, such as that described in Application No. DE 27 47 626, is easy to operate but poorly protected.

In fact, by virtue of its dimensions and positioning, the long operating tongue can be quite easily raised accidentally, for example when the skis are being handled.

A locking device such as that described in Applications Nos. DE 30 15 478 and FR 2 451 756 is more effectively protected, since it provides little occasion for gripping outside the volume of the body. However, longitudinal adjustment requires the use of a tool. The use of this device is, therefore, not simple for the specialist.

A locking device as described in Application No. FR 2 672 506 offers an effective compromise between effective protection for the user and ease of operation for the specialist. In addition, the specialist can easily move the body. In fact, by placing the thumb, for example, on the body of the element and by raising the buckle with the index finger, the specialist secures a good grip allowing him to move the body easily into its new position. This locking device is, however, mechanically complex to manufacture, since several connection elements are required to have access to the locking device itself.

A locking device of the same kind is described in the Patent Publication under No. AT 2107/92.

SUMMARY OF THE INVENTION

One purpose of the invention consists in improving existing adjustment devices and in producing a longitudinal adjustment device providing effective compromise between ease of manufacture for the manufacturer, accessibility and ease of operation for the specialist, and protection against accidental opening for the user.

The invention proposes to achieve this goal by extending the horizontal part of the locking device using a control mechanism extending along the rear face of the body of the position-retention element and having an overall "T" shape, in which the arms of the upper horizontal bar can be raised using two fingers.

According to one preferred embodiment, the control mechanism is made of a flexible material.

According to another preferred embodiment, the base of the control mechanism incorporates a sloping surface extending upward and forward.

BRIEF DESCRIPTION OF THE DRAWINGS

The invention will be better understood by referring to the following description and to the drawings, which form an integral part thereof.

DETAILED DESCRIPTION

Figure 1:
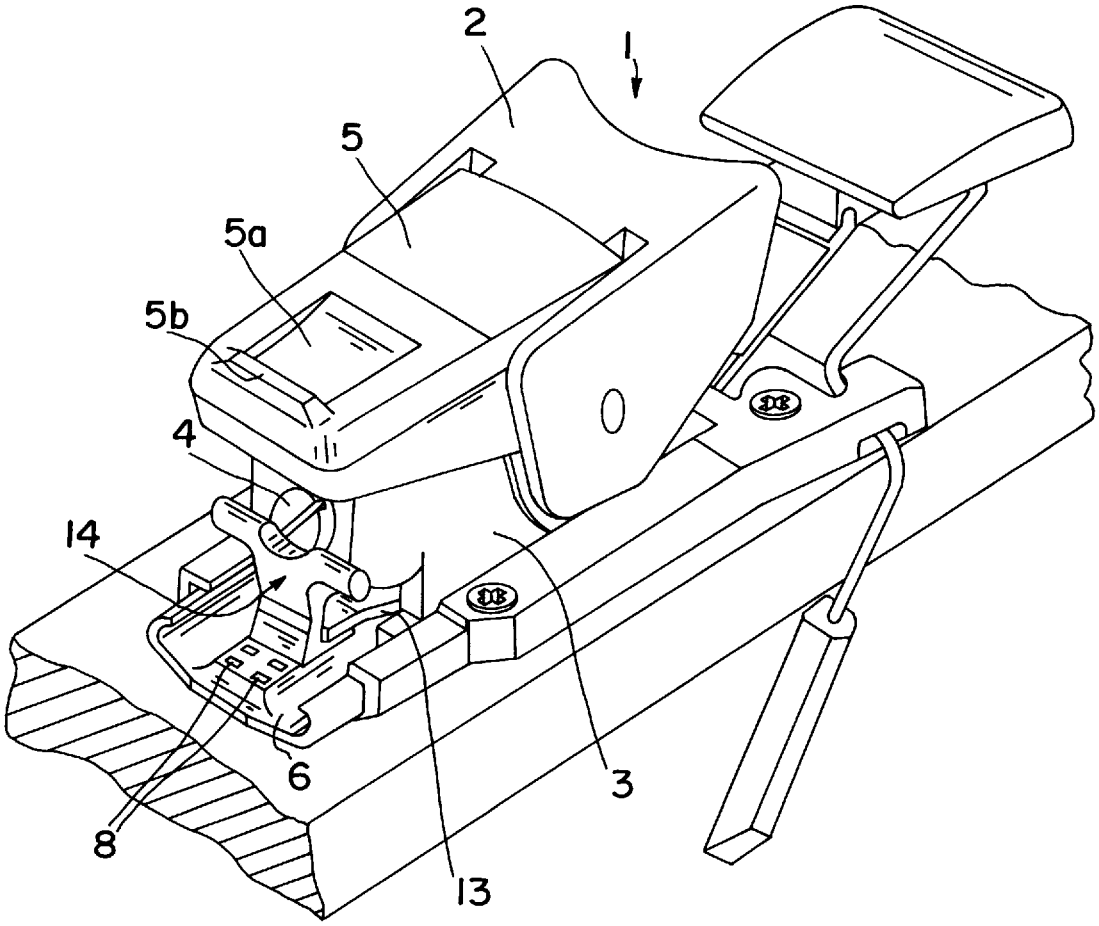
FIG. 1 is a perspective view of a rear position-retention element equipped with the longitudinal adjustment device according to the invention.
Figure 3:
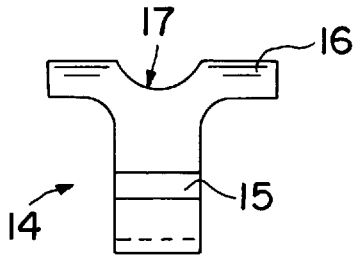
FIG. 3 is a front view of the control mechanism with which the device in FIGS. 1 and 2 is equipped.
Figure 2:
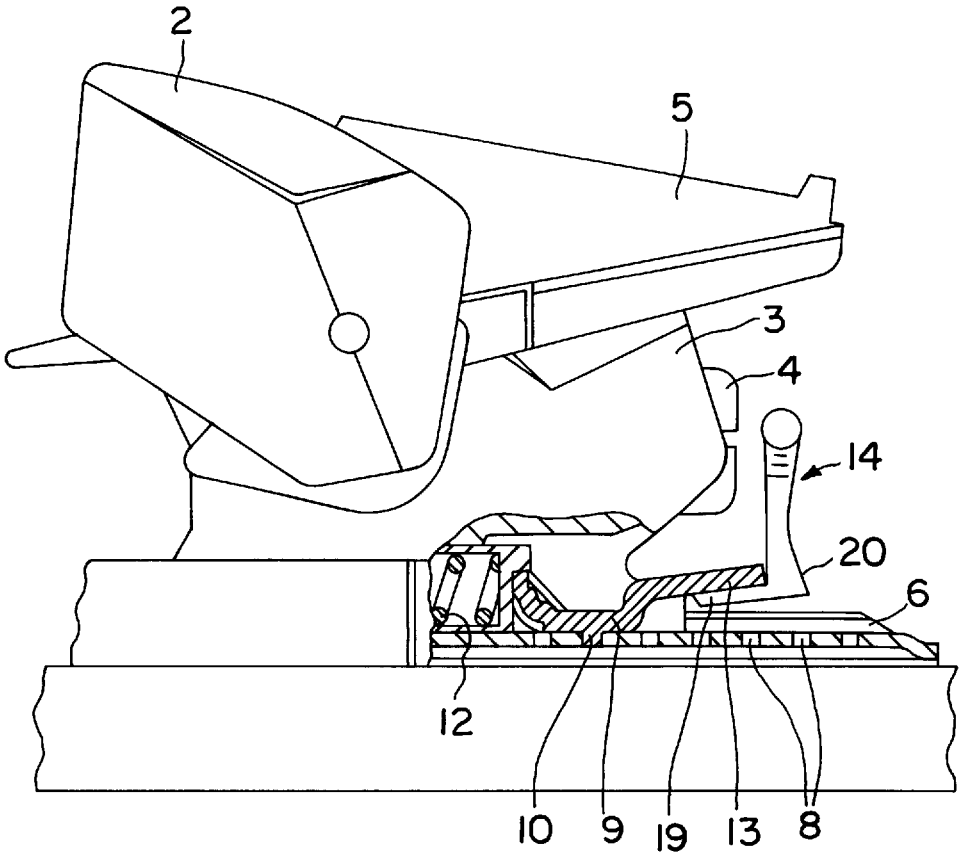
FIG. 2 is a side view in partial cross-section of the rear portion of the position-retention element in FIG. 1.

FIG. 1 illustrates a rear position-retention element 1. In conventional fashion, this element incorporates a jaw 2 carried by a body 3. The jaw is movable around a transverse pin carried by the body, and its movement is controlled by a spring housed in the body. Initial compression of the spring is made adjustable by a plug 4 accessible on the rear face of the body. The plug is located approximately at a point mid-way up the body.

Also conventionally, the jaw has two stable positions of equilibrium, namely, a lower boot-retention position and a raised boot-release position. FIG. 1 illustrates the position-retention element with the jaw in the raised position. A boot-release lever 5 makes it possible to move the jaw into the raised position by means of a voluntary action. The lever 5 is jointed to the body in the area of the axis of rotation of the jaw. In FIG. 1, when the jaw is in the raised position, the boot-release lever is shown resting horizontally on the rear part of the body. In this position, the rear end of the lever 5 extends a little beyond the body. This rear end preferably incorporates a recess 5*a* in which the end of the rod can be engaged and a projecting shoulder 5*b*.

The body 3 is mounted so as to slide along a slide-rail 6 made integral with the ski.

The position of the body along the slide-rail is defined using longitudinal adjustment means. In FIG. 1, the slide-rail has a central, elevated portion provided with a plurality of holes 8. In its lower portion and to the rear, the body 3 incorporates a locking device 9 equipped with teeth 10, which are provided to be engaged in one or several holes adjoining the slide-rail.

The locking device 9 is mounted for sliding movement inside the body, and a backward-motion spring 12 housed in the rear portion of the body pushes the stopped locking device toward the rear of the body. The backward-motion spring 12 determines the thrust which the position-retention element exerts on the boot.

According to the embodiment shown, the backward-motion spring also draws the locking device back into its locking position, i.e., its lowered position, in which the teeth of the device are engaged in holes. From this position, the locking device can be raised until the teeth are released from the holes in the slide-rail. In the present instance, the raised position of the locking device is not intended to be a stable position. However, as will emerge below, the invention could be made applicable to locking devices having two stable positions.

To the rear, the locking device incorporates an operating tongue 13. The rear end of this tongue is extended upward by a control mechanism 14.

The control mechanism 14 extends upward along the rear face of the body. Seen from the front, it has the general shape of a "T" incorporating a central vertical member 15 and an upper transverse bar 16. This device is substantially plumb with the rear end of the boot-release lever, when the lever rests horizontally along the body.

The control mechanism is to be used in the following way. Normally, the longitudinal position of the body is adjusted while the jaw is in open position and while the boot-release lever is in horizontal position. Moreover, to accomplish the adjustment, the specialist is accustomed to laying the skis flat facing him, the tip to his left and the heel to his right.

The locking device is actuated using a natural motion, the thumb on the end of the lever 5 and by placing the index and second fingers (or two other fingers) beneath the two arms of the transverse bar 16, then by exerting an upward tractive force on the transverse bar. The body may then be moved any easily while continuing to apply the upward tractive force on the control mechanism and by moving the body longitudinally forward or backward by virtue of the grip secured by using the thumb and two other fingers. Furthermore, by inserting this tip of the thumb in the recess 5*a,* the longitudinal movement is facilitated. To immobilize the locking device once again, it is necessary only to release the control mechanism and to exert a low level of thrust on the body either forward or backward, so that the teeth belonging to the locking device are inserted in the holes in the slide-rail.

If the locking device has two stable positions, it can be drawn very simply into the lowered position by placing the thumb in the middle of the transverse bar 16, and then exerting a downward thrust on this bar. This movement can also be performed very naturally.

The height dimension of the control mechanism is such that, in the raised position of the locking device, the transverse bar does not abut against the rear end of the lever, but remains underneath it. Under these conditions, the control mechanism has a height approximating one-half of the height of the body.

In the embodiment shown, the mechanism has a recess 17 in the center of the transverse bar. This recess is provided to maintain access to the plug 4.

The vertical member 15 has a substantially rectangular section, of which the largest dimension substantially matches the width of the locking device.

The transverse bar incorporates an approximately circular section, at least at the end of its arms. The arms of the bar 16 extend on each side of the vertical member 15 over a distance corresponding approximately to one-half the width of the index or second finger of a human being, or about 10 millimeters, and the arms are joined to the vertical member by a quarter-circle rib whose curvature is approximately that of the end of the index or second finger. These shapes and dimensions are intended to facilitate gripping of the control mechanism; however, they do not limit the invention, and any other suitable shape or dimension is appropriate.

Preferably, the control mechanism is flexible, i.e., it is made, for example, of a deformable plastic material or an elastomer. Nevertheless, the stiffness of the control mechanism is sufficient to ensure that it will remain by itself raised along the rear face of the body. Because the locking device is itself made of a rigid material, given its function, the control mechanism is assembled to the locking device using any suitable means. For example, as illustrated, the device 14 is extended forward by a tongue 19, which passes beneath the rear end of the locking device, and which is assembled to this end, for example by screws or rivets. Any other mechanical means of assembly, adhesive bonding, etc., is also suitable. If the locking device is made of metal and the control mechanism is made of a vulcanizable elastomer, the control mechanism may be made by counter-molding on the end of the locking device. The assembly is automatically produced when the elastomer is vulcanized.

The flexibility of the control mechanism renders the device and the body of the position-retention element less sensitive to impacts. In fact, in the event of impact, the control mechanism is deformed and pressed against the rear face of the body it protects. Deformation also allows the control mechanism to absorb each impact.

Preferably the base of the vertical member of the control mechanism has an inclined surface sloping upward and forward. Because of this inclined surface, impacts occurring at the base of the control mechanism generate a downward component in the locking device. This component opposes the opening of the locking device. Moreover, deformation of the control mechanism caused by the impact increases the slope of the inclined surface 20 in the direction in which it prevents the locking device from opening.

The control mechanism just described facilitates operation of the locking device. It also makes the device safer, since operation of the locking device and the longitudinal motion of the body occur easily and naturally only if the ski is positioned facing the person handling it, the tip on the left and the heel on the right. In other cases, either the opening of the locking device or the movement of the body requires a substantial, purposeful effort.

The locking device is advantageously raised easily only if the two arms of the transverse bar 16 are stressed simultaneously. If only one of the arms is grasped, the control mechanism responds by undergoing deformation, in the advantageous case in which it is flexible.

The device just described may be manufactured very simply. It requires no special arrangement incorporated into the body of the position-retention element, except for the locking device itself, and, more precisely, the rear end of the locking device.

For the user, the locking device is protected against accidental opening, in particular because of its flexibility and of the inclined surface at the base of the vertical member.

The invention is not limited to a rear position-retention could also be applied to a front position-retention element having a body moveable along a slide-rail. In that case, the device could be positioned on the front or side of the body.

What is claimed is:

1. An element for position retention of a boot on a sliding board, comprising a body movable along a slide-rail, a locking device carried by the body and adapted to immobilize the body along the slide-rail in a defined position, wherein said locking device has a rear extension which is attached to a flexible control mechanism which extends upward over a portion only of a height of the body, said control mechanism having a "T" shape incorporating a single central vertical member surmounted by a transverse bar with two arms with free ends extending on each side of said central vertical members so as to permit engagement of each of said arms by a finger of a single hand of a user.

2. The element according to claim 1 wherein said vertical member has an exterior face a lower portion of which incorporates an inclined surface extending upwardly and forwardly, so that a forward horizontal force applied to said inclined surface deflects the control mechanism downward.

3. The element according to claim 1, wherein at least said free ends of said transverse bar have a substantially circular section.

4. The element according to claim 1, wherein said transverse bar is connected to said vertical member by arc-shaped ribs.

5. The element according to claim 1 comprising a jaw carried by said body, a lever adapted to open said jaw and being movable between an upper and a lower position, in which said lever extends horizontally along said body and a rear end of said lever extends beyond a rear face of said body, wherein said control mechanism extends upward substantially plumb with said rear end of said lever when said lever is in horizontal position.

6. The element according to claim 5, wherein said control mechanism extends substantially to a mid-point of a height of said rear face of said body.

7. The element according to claim 6, wherein said control mechanism incorporates a recess in a central portion of said transverse bar.

8. The element according to claim 1, wherein each of said arms extends about 10 millimeters from said central vertical member.

* * * * *